US012686533B1

(12) United States Patent
Wherley

(10) Patent No.: US 12,686,533 B1
(45) Date of Patent: Jul. 21, 2026

(54) OVERCOAT BUCKET SUPPORT

(71) Applicant: Decorative Concrete Images, Inc., Carver, MN (US)

(72) Inventor: Andrew Wherley, Carver, MN (US)

(73) Assignee: Decorative Concrete Images, Inc., LeSeuer, MN (US)

( * ) Notice: Subject to any disclaimer, the term of this patent is extended or adjusted under 35 U.S.C. 154(b) by 0 days.

(21) Appl. No.: 19/073,276

(22) Filed: Mar. 7, 2025

(51) Int. Cl.
*B65D 25/24* (2006.01)

(52) U.S. Cl.
CPC ..... *B65D 25/24* (2013.01)

(58) Field of Classification Search
CPC ..... B65D 25/24; B65D 25/22; B65D 25/20; F16M 11/041; F16M 11/04; B44D 3/14
USPC ..... 220/636, 634, 632, 630, 628; 248/154, 248/149, 146, 127
See application file for complete search history.

(56) References Cited

U.S. PATENT DOCUMENTS 1,023,982 A * 4/1912 Barnes ..... A47G 7/025 248/153
1,056,669 A * 3/1913 Harris ..... A47G 7/025 248/154
1,382,115 A * 6/1921 Ohme ..... A47J 47/16 248/156
1,481,137 A * 1/1924 Lemke ..... A47G 7/041 47/72
1,639,249 A 8/1927 Allen
1,922,127 A * 8/1933 Foley ..... A47J 47/19 220/630
4,925,048 A 5/1990 Noack
5,839,598 A * 11/1998 Mitchell ..... B65D 1/16 220/729
6,047,842 A 4/2000 Feidt
7,726,621 B1 6/2010 Dellinger
7,814,680 B2 10/2010 Adami
7,984,821 B1 7/2011 Malmberg
8,215,030 B2 7/2012 Bowen et al.
9,004,309 B1 * 4/2015 Gardner ..... B01F 35/42 248/500
9,828,162 B2 11/2017 Bachman et al.
11,173,576 B1 11/2021 Harrell
2007/0252051 A1 11/2007 Kuipers
2008/0042035 A1 2/2008 Elwood
2008/0178492 A1 7/2008 Coomer
2009/0100721 A1 4/2009 Gorynski
2012/0298537 A1 11/2012 Calderon
2014/0008926 A1 1/2014 Allen
2016/0101646 A1 4/2016 Kiceniuk
2017/0253415 A1 9/2017 Schneider
2018/0184601 A1 7/2018 Graffius
2019/0263564 A1 8/2019 Robertaccio
2022/0009278 A1 1/2022 Casey
(Continued)

*Primary Examiner* — Robert J Hicks
(74) *Attorney, Agent, or Firm* — Dietz Law Office LLC

(57) ABSTRACT

A concrete overcoat bucket support adapted for elevating a bucket above a concrete surface being resurfaced. The concrete overcoat bucket support is adapted for supporting a five-gallon bucket above an uncured overcoat. The concrete overcoat bucket support apparatus of the present invention includes spikes so that an overcoat bucket for resurfacing the concreate may be supported above an uncured area being resurfaced without leaving permanent markings in the uncured surface when the concrete overcoat bucket support apparatus is lifted and moved.

14 Claims, 9 Drawing Sheets

(56) References Cited

U.S. PATENT DOCUMENTS

| | | | |
|---|---|---|---|
| 2022/0264990 | A1 | 8/2022 | McGonigal |
| 2024/0058831 | A1 | 2/2024 | Ferdman |
| 2024/0334899 | A1 | 10/2024 | Duke et al. |

* cited by examiner

OVERCOAT BUCKET SUPPORT

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to an accessory used when resurfacing a floor or other surface with an epoxy, liquid, or other overcoat material. More particularly, this invention relates to an overcoat bucket support adapted for elevating a bucket above an uncured liquid or overcoat that has been applied to the surface being resurfaced. The overcoat bucket support apparatus of the present invention includes spikes that elevates the bucket and leaves minimal markings in the uncured overcoat such that the markings fill in or "heal" when the spikes are lifted out of the uncured overcoat.

BACKGROUND

Often times it is desirable to apply an epoxy, liquid or other overcoat material to a surface. Applying an overcoat is sometimes referred to as resurfacing or enhancing the surface. By way of example, concrete flooring, ship hulls, building roofs and other surfaces are resurfaced or enhanced with liquid coatings or overcoats. Typically, the overcoat material is supplied in liquid form in five-gallon buckets and the overcoat material is dispensed or applied to the surface from the five-gallon bucket. A thin layer of the liquid is squeegeed or otherwise spread across the surface. Where to place the five-gallon bucket is often a conundrum. When the bucket is placed and moved to unfinished areas, the bucket tends to get in the way and slow down the application process. However, when the bucket is placed on the finished surface and then moved, the bucket leaves a mark in the finished surface which requires re-spreading the overcoat to eliminate the marks. Although a common five-gallon bucket has a rim extending from a bottom of the bucket, to reduce the surface area in contact with the surface being resurfaced, the rim leaves a marking in the uncured overcoat and this marking remains in the overcoat as the coating cures.

It is desirable to place the bucket on the finished area without leaving permanent marks in the overcoat and without requiring re-spreading of the overcoat to eliminate markings. The present invention provides an apparatus and method for elevating a bucket (filled with overcoat) above an uncured overcoat finished surface without leaving permanent markings in the overcoat.

SUMMARY

Embodiments according to aspects of the invention include an apparatus and method for supporting and elevating an overcoat bucket above an uncured overcoat surface. An embodiment of the overcoat bucket support includes an annular ring adapted for supporting a bottom portion of a bucket. The annular ring has an annular base with a central opening, wherein an upper surface of the annular base has a cylindrical sidewall extending upward from an outer edge of the upper surface of the annular base. The lower surface of the annular base has spaced apart spikes extending downward from the lower surface of the annular base. The spikes elevate a bottom of the annular ring above the supporting surface by a distance approximately equal to a length of the spikes. An inner side of the cylindrical sidewall has spaced apart pliable tabs extending inward towards a center of the annular ring from the cylindrical sidewall. The pliable tabs bend when the bucket is inserted into the annular ring and applies pressure to an outer sidewall of the bucket. The applied pressure retains the bucket support under the bucket when a user lifts the bucket to move the bucket.

Embodiments in accordance with these aspects of the invention may further provide an annular lip extending upward from the inner edge of the annular base of the concrete overcoat bucket support. Also, the spikes may include a cylindrical portion extending from a conical base, wherein the cylindrical portion has a diameter sized to leave pinholes in an uncured overcoat layer when the bucket is lifted from the uncured overcoat surface. Further, a length of cylindrical portion of spike may be at least 0.375 inches long which elevates the bottom of the annular ring above the thickness of the overcoat. Also, a tip of the cylindrical portion of the spike may have a diameter that is less than 0.100 inch in diameter. In certain embodiments the spikes are removable from the annular base. Also, the annular cylindrical sidewall extending from the annular base may include spaced apart apertures formed through the cylindrical sidewall. Additionally, the pliable tabs extending inward from the cylindrical sidewall may include gripping ledges extending upward from an upper planar surface of the tabs which further grip the side of a bucket inserted into the overcoat bucket support.

In accordance with aspects of the invention, an alternative embodiment of the present invention includes an annular ring adapted for supporting a bottom portion of a bucket, wherein the annular ring has an annular base with a central opening. An upper surface of the annular base has a cylindrical sidewall extending upward from an outer edge of the upper surface of the annular base. Further, the cylindrical sidewall has spaced apart apertures formed through the cylindrical sidewall. An inner edge of the annular base has an annular lip extending upward from the inner edge of the annular base. The lip creates an annular tray that catches overcoat that drips along the outer sides of the bucket, thereby keeping the overcoat from dripping onto the finished surface. A lower surface of the annular base has spaced apart spikes extending downward from the lower surface of the annular base. Additionally, the cylindrical sidewall has spaced apart pliable tabs extending inward towards a center of the annular ring from the cylindrical sidewall.

Embodiments according to these aspects of the invention may further include spikes that have a cylindrical portion extending from a conical base portion of the spike. The cylindrical portion of the spike has a length that is at least 0.375 inches long and a tip portion of the cylindrical portion is less than 0.100 inch in diameter. Additionally, the spikes may be removable from the annular base. By way of example, the spikes may include a threaded stem that screws into threaded apertures formed in the bottom of the base of the annular ring. Alternatively, the spikes may be press fit into apertures or held in place with other known fastening devices. Further, the tabs extending inward from the sidewall may include gripping ledges extending upward from an upper planar surface of the tabs.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

Figure 1:
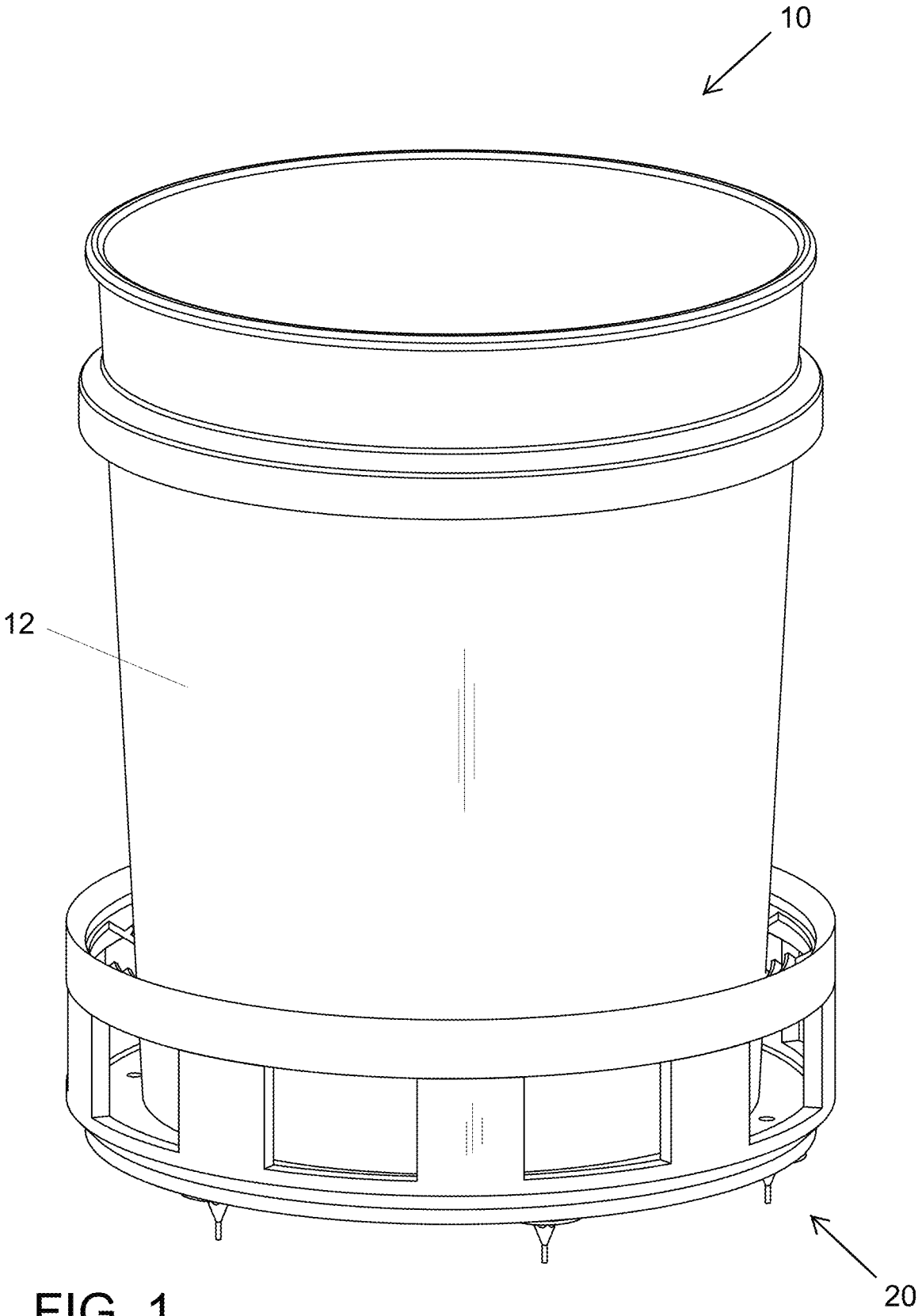
FIG. 1 is a front perspective view of an overcoat bucket support in accordance with aspects of the present invention shown supporting a bucket.
Figure 2:
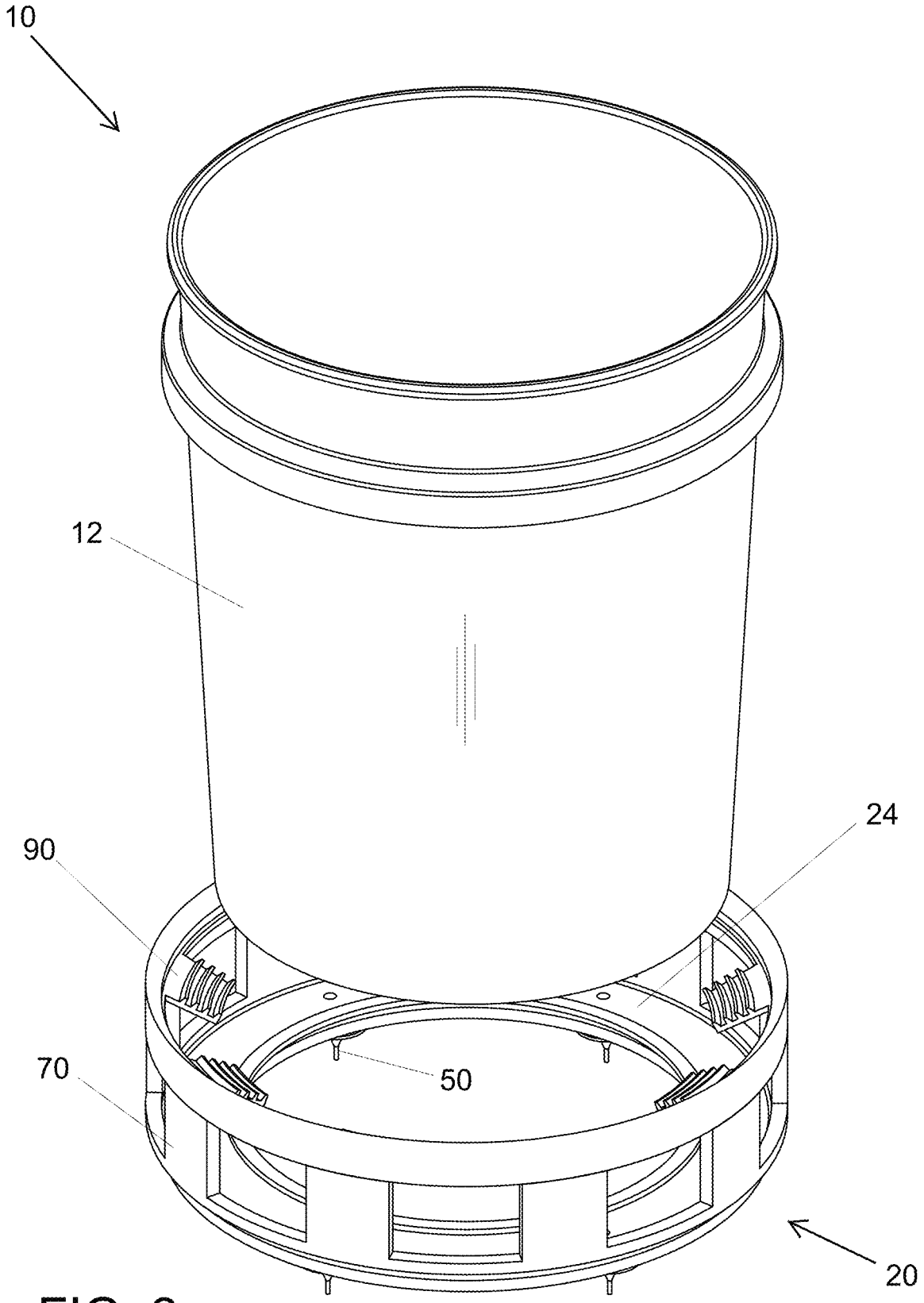
FIG. 2 is a top perspective view of an overcoat bucket support in accordance with aspects of the present invention showing a bucket partially elevated above the overcoat bucket support.
Figure 3:
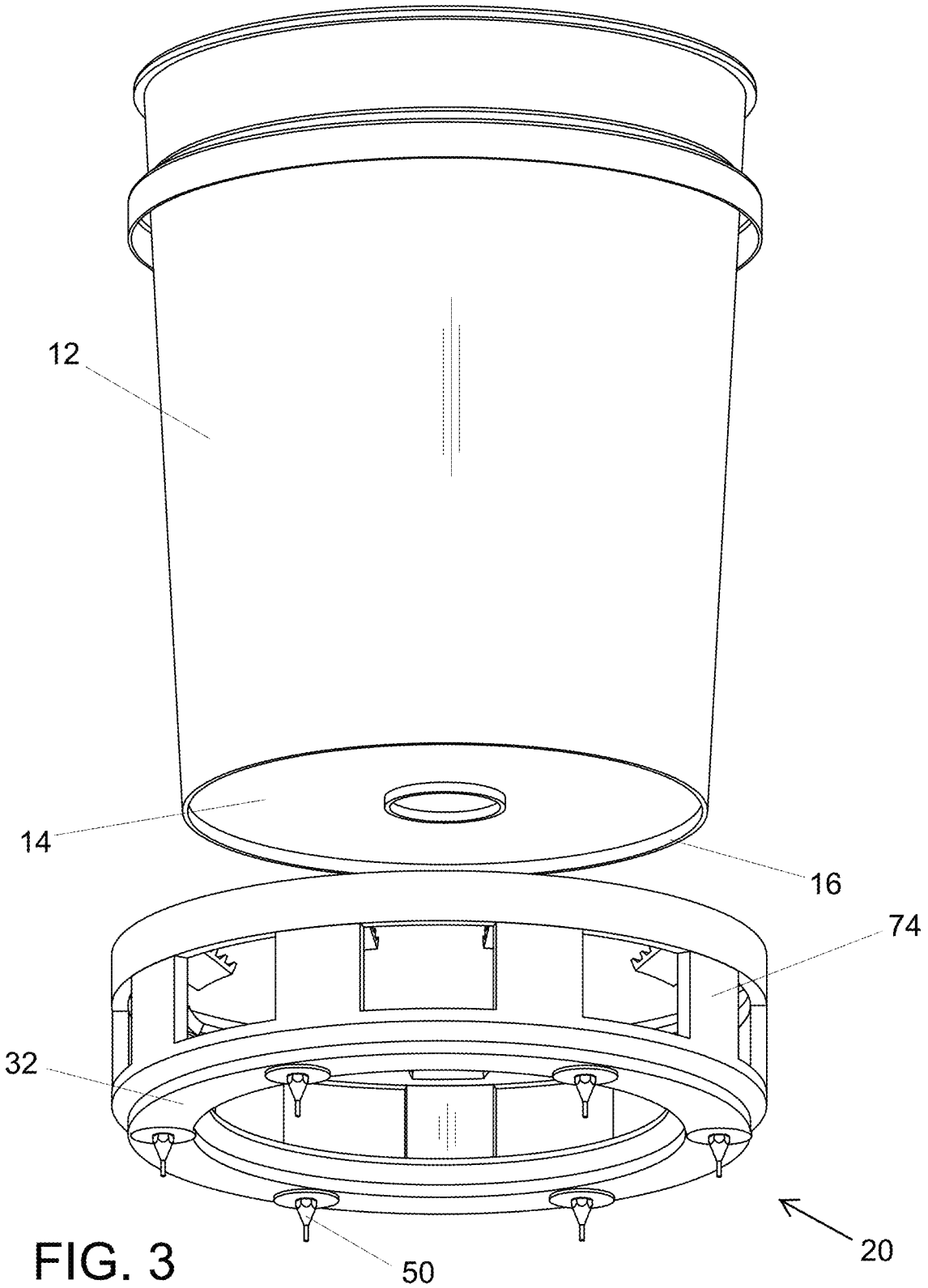
FIG. 3 is a bottom perspective view of an overcoat bucket support in accordance with aspects of the present invention showing a bucket partially elevated above the overcoat bucket support.
Figure 4:
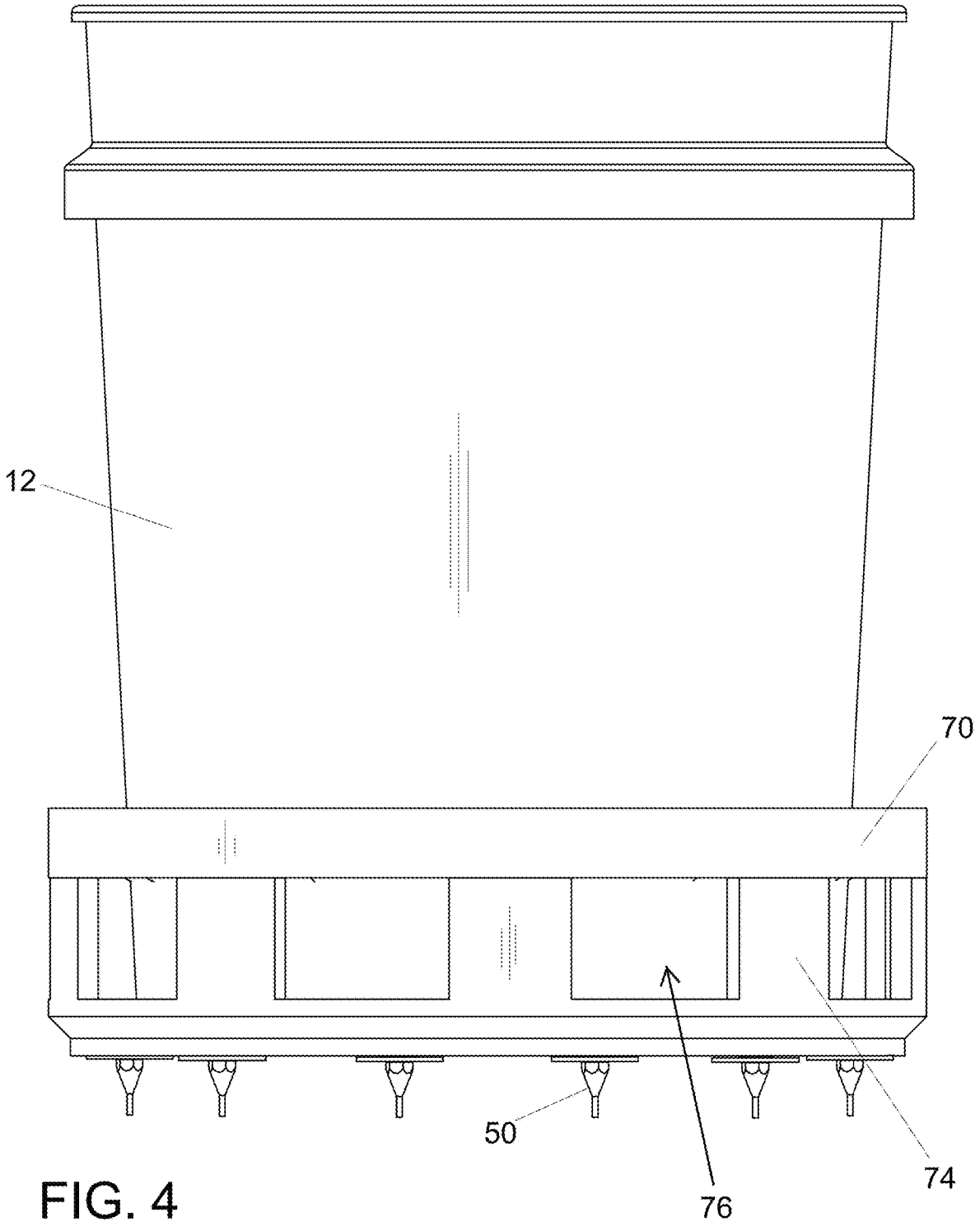
FIG. 4 is a side elevational view of an overcoat bucket support in accordance with aspects of the present invention shown supporting a bucket.
Figure 5:
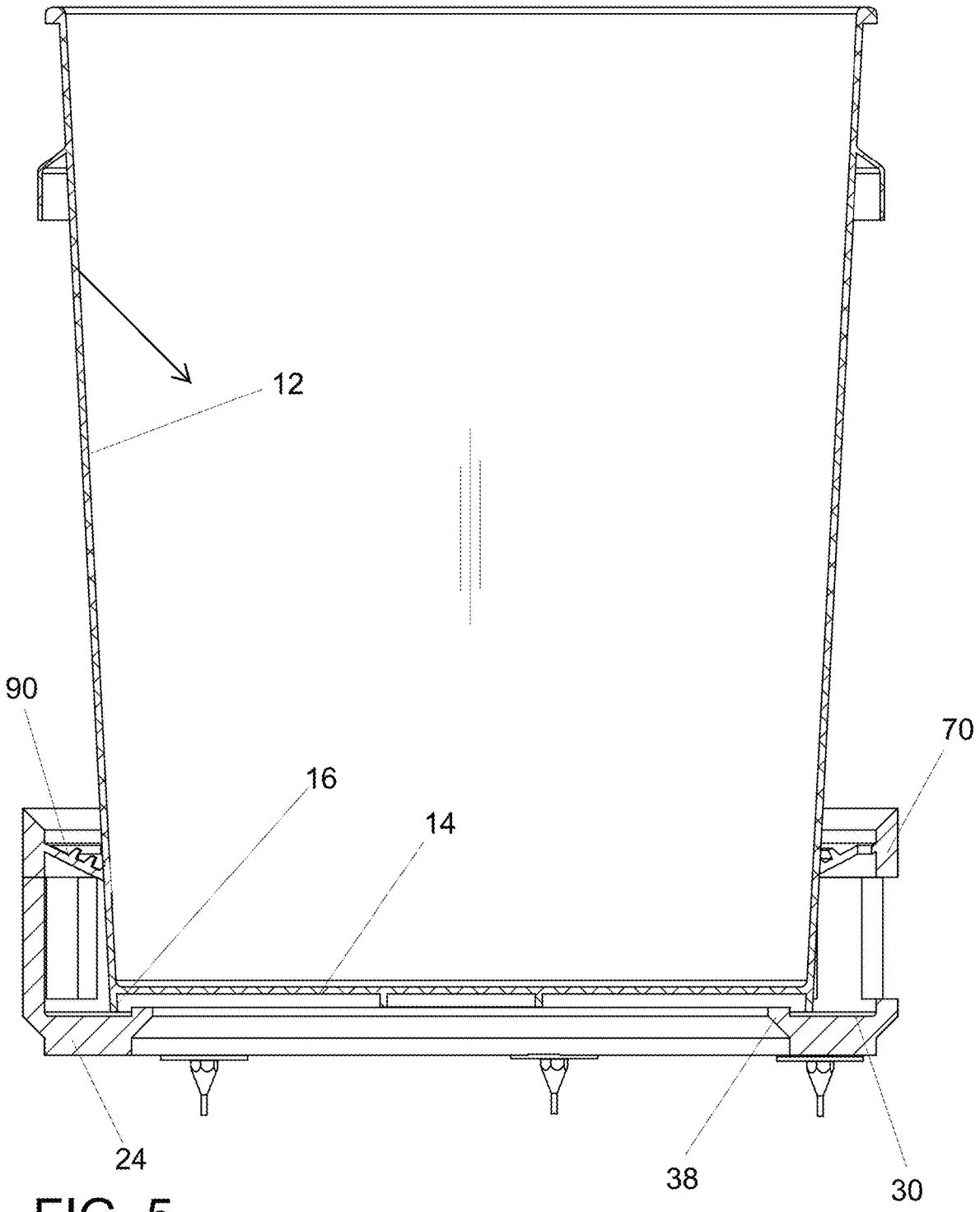
FIG. 5 is a partial sectional side elevational view of an overcoat bucket support in accordance with aspects of the present invention shown supporting a bucket.

The overcoat bucket support 10 of the present invention is well suited to elevate the bottom 14 of a bucket or pail 12 above a supporting surface. With reference to FIGS. 1-5, the overcoat bucket support 10 includes an annular ring 20 that is adapted for engaging an outer side of a bucket 12 and supporting the bottom 14 of the bucket 12. A typical pail or bucket 12 includes an outer rim 16 extending downward from the bottom 14 of the bucket 12. The rim 16 of the bucket elevates most of the bottom 14 of the bucket 12 above a supporting surface so that the rim 16 of the bucket contacts the supporting surface. When the bucket 12 is placed on an uncured overcoat surface, the rim makes an impression in the uncured overcoat. When the bucket is lifted off the uncured surface the uncured overcoat may fill into the impression, however, the impression is too significant for the overcoat to completely fill in the impression.

The present invention supports the rim 16 and underside or bottom 14 of bucket 12 and elevates the bottom 14 above the supporting surface. When a user applies the overcoat or liquid oftentimes a small amount of the liquid may spill over the outer sides of the bucket. When applying an overcoating onto a supporting surface it is desirable to restrict the spillage from the bucket from spilling or dripping onto the overcoat applied to the supporting surface. The annular ring 20 of the present invention includes a concentric annular base 24 that has an annular lip 38 that extends upward from an inner edge 34 of top surface 30 of the base 24. The outer edge 36 of the annular base 24 includes a cylindrical sidewall 70 extending upward from the annular base. A trough or receptacle is formed between the cylindrical sidewall 70, the top surface 30 of the annular base 24 and the annular lip 38. This receptacle captures the spillage from the bucket when the bucket is supported by the annular ring 20. When a bucket 12 is lowered onto the top 30 of the annular base 24, pliable tabs 90 bend downward and apply a force against an outer surface of the bucket. The pliable tabs 90 retains the annular ring 20 under the bucket 12 when the bucket is lifted and moved during the overcoat application process.

Figure 6:
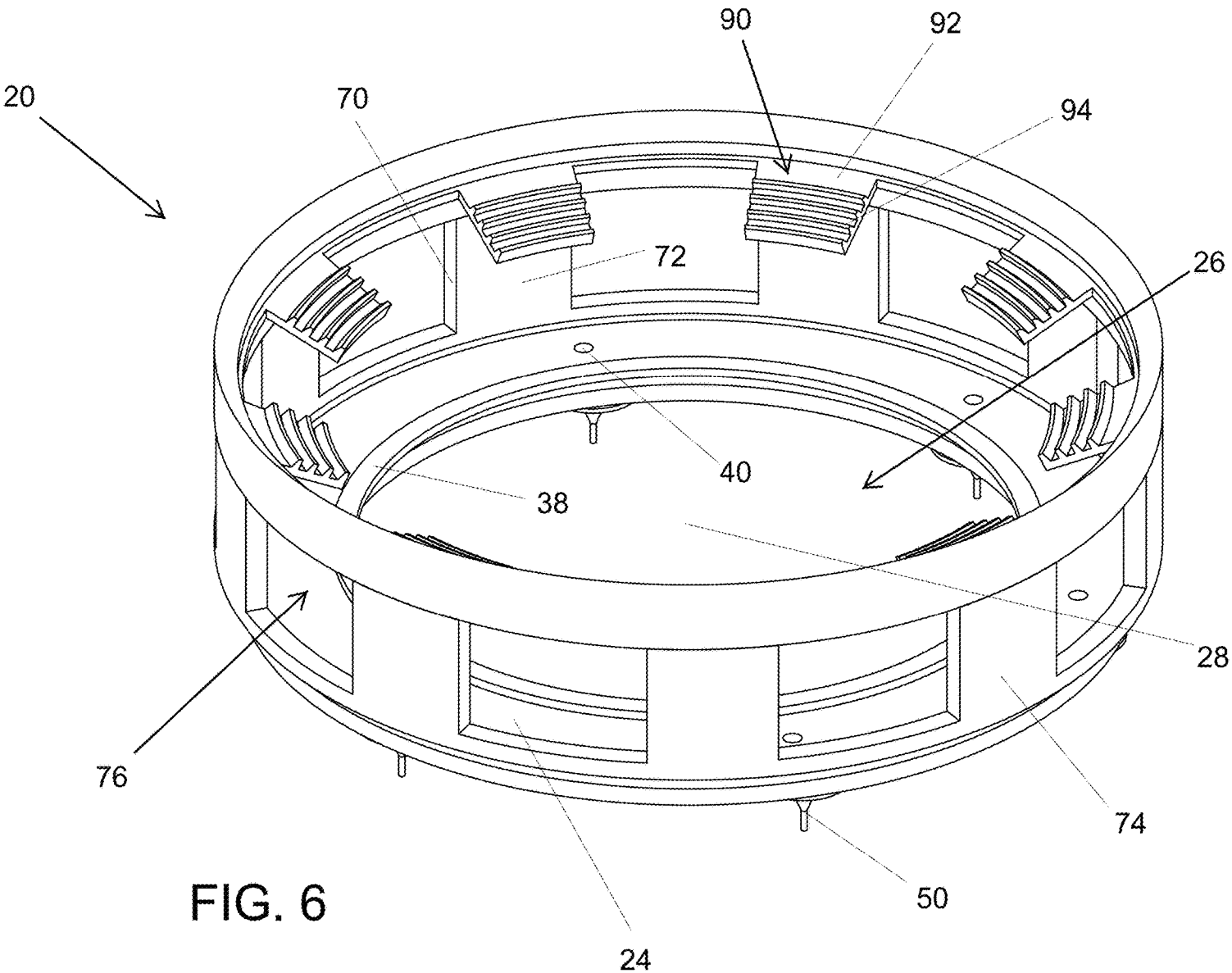
FIG. 6 is a top perspective view of an overcoat bucket support in accordance with aspects of the present invention.
Figure 7:
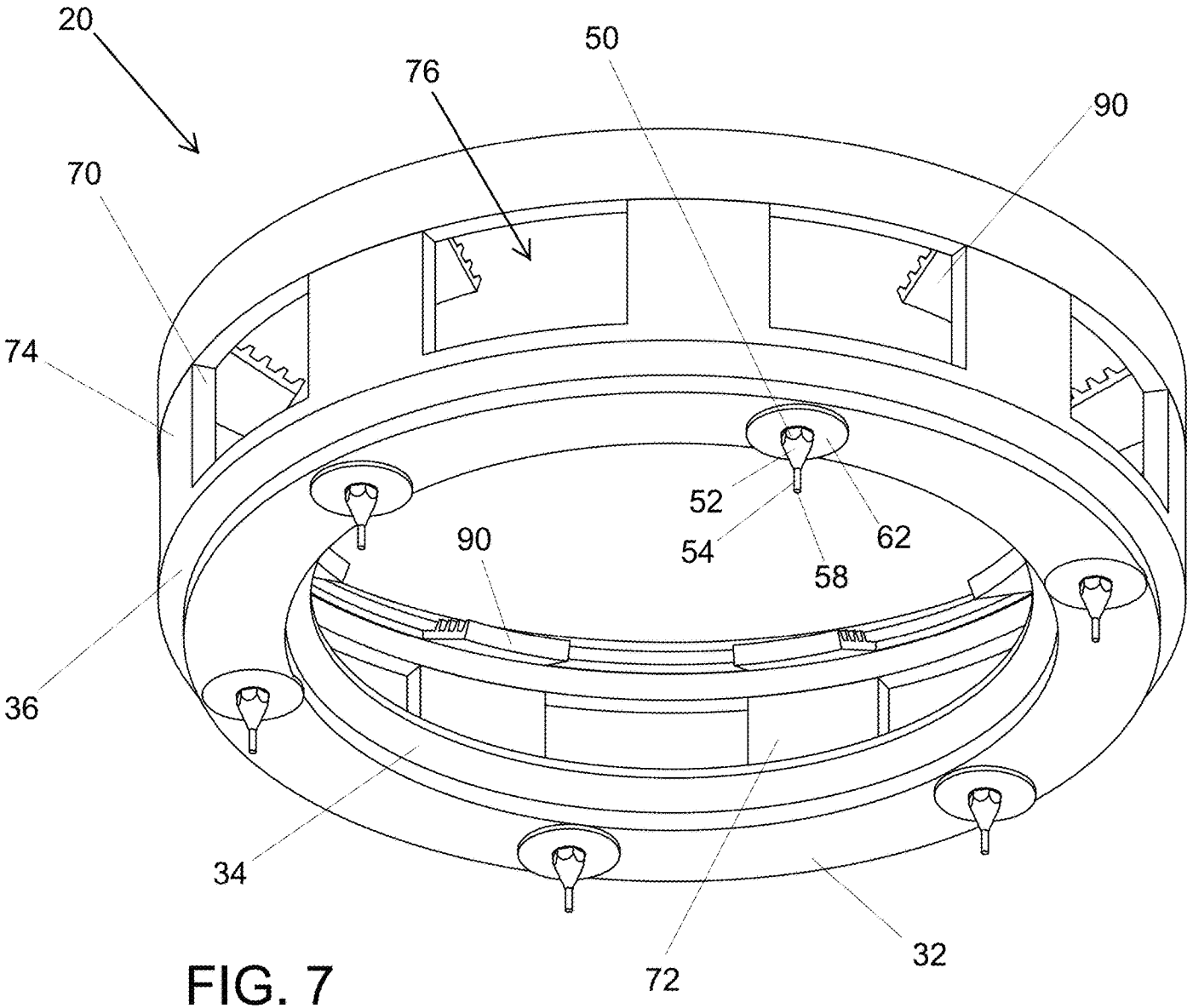
FIG. 7 is a bottom perspective view of an overcoat bucket support in accordance with aspects of the present invention.
Figure 8:
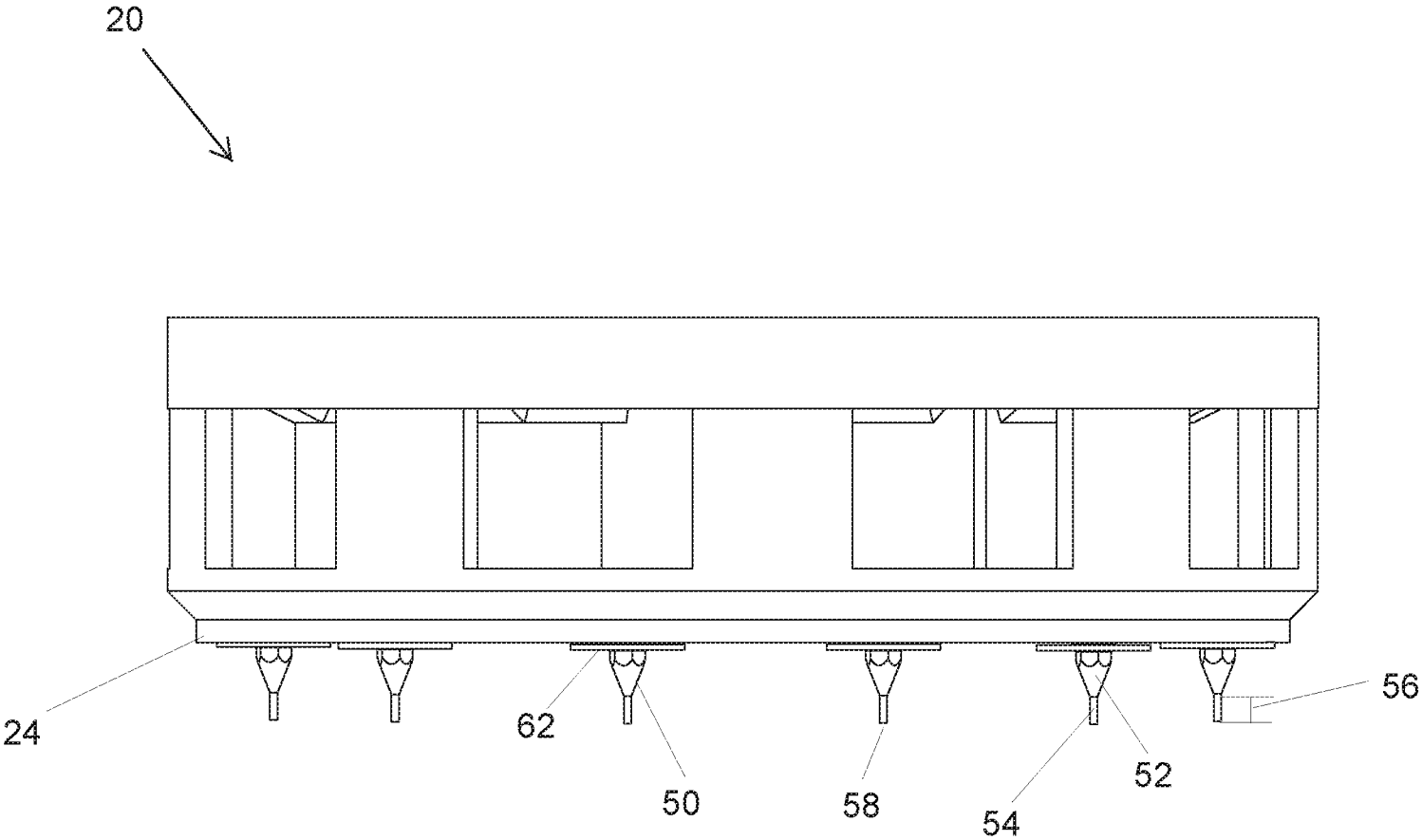
FIG. 8 is a side elevational view of an overcoat bucket support in accordance with aspects of the present invention.
Figure 9:
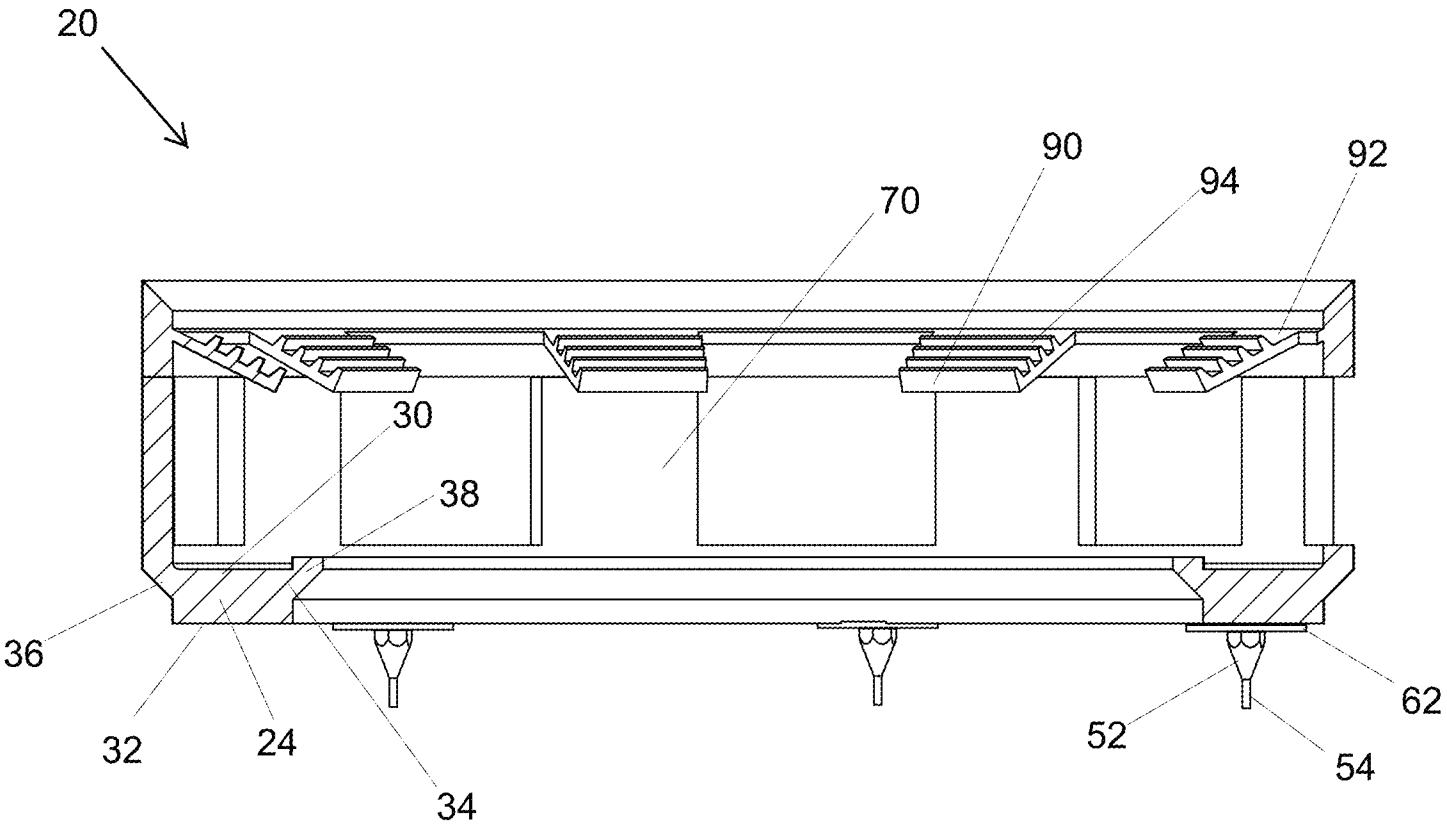
FIG. 9 is a partial sectional side elevational view of an overcoat bucket support in accordance with aspects of the invention.

Referring next to FIGS. 6-9 the annular ring 20 will be described in greater detail. The annular ring 20 includes a concentric annular base 24 having a central opening 26 and a center of annular ring 28. The annular base 24 further has a top 30 of base 24 and a bottom 32 of the base 24. The annular base 24 also has an inner edge 34 of the base and an outer edge 36 of base. The annular lip 38 extends upward from inner edge 34 and top 30 of the annular base 24. Without limitation intended, the annular ring 20 may be constructed from polymers such as rubber or plastic. The annular base 24 further includes apertures 40 that are adapted for receiving removable spikes 50.

Spikes 50 may be formed integral with the annular ring 20 or may be removable from the annular ring 20. Spaced apart spikes 50 extend downward from bottom 32 of the base 24. Although the spikes 50 may take on many shapes, an embodiment of the present invention includes spikes 50 having a conical base portion 52 and a cylindrical portion 54 extending from a point of the conical base. The cylindrical portion 54 includes a length 56 that is preferably at least 0.375 inches long, however the length of the cylindrical portion should be at least slightly greater than a thickness of the overcoat being applied to a supporting surface. An outer tip 58 of the cylindrical portion preferably has a diameter of less than 0.100 inches such that when the spikes are lifted out of an uncured overcoat, only small pinhole depressions remain in the uncured overcoat. It has been found that the pinhole depression left in the overcoat by tips 58 having a diameter of less 0.100 inches will completely fill in before the overcoat cures, thereby leaving a smooth surface. A threaded stem (not shown) may extend from the conical base and provide a construct to affix the spikes within the apertures 40 of the annular ring 20. Washers 62 may be positioned between the spikes 50 and bottom 32 of the base 24 of the annular ring 20. Use of washers 62 are preferred when the annular ring 20 is made from a polymer and the spikes 50 are made from a rigid material such as a metal.

The annular ring 20 includes a concentric cylindrical sidewall 70 extending upward from a top 30 of the base 24. The cylindrical sidewall 70 has an inner side 72 of the sidewall 70 and an outer side 74 of the sidewall 70. Apertures 76 extend through the sidewall 70. The cylindrical sidewall 70 retains and centers a bucket 12 resting on the base 24 of annular ring 20. Pliable tabs 90 extend inward from the inner side 72 of the cylindrical sidewall 70. The pliable tabs 90 engage a side surface of bucket 12 and further provide resistance to retain the bucket 12 within the annular ring 20. The pliable tabs 90 has ledges 94 extending upward from an upper surface 92 of the tabs 90. The ledges 94 provide an additional gripping surface against the bucket 12.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open-ended sense in that elements in addition to those enumerated may also be present. Other examples will be apparent to those of skill in the art upon reviewing this document.

The following claims are incorporated into this description.

The invention claimed is:

1. An overcoat bucket support apparatus, the apparatus comprising:

an annular ring adapted for supporting a bottom portion of a bucket, the annular ring having an annular base with a central opening, wherein an upper surface of the annular base has a cylindrical sidewall extending upward from an outer edge of the upper surface of the annular base; further wherein a lower surface of the annular base has spaced apart spikes extending downward from the lower surface of the annular base; and further wherein the cylindrical sidewall has spaced apart pliable tabs extending inward towards a center of the annular ring from the cylindrical sidewall.

2. The overcoat bucket support apparatus as recited in claim 1, wherein an inner edge of the annular base has an annular lip extending upward from the inner edge of the annular base.

3. The overcoat bucket support apparatus as recited in claim 1, wherein the spikes include a cylindrical portion extending from a conical base.

4. The overcoat bucket support apparatus as recited in claim 3, wherein a length of a cylindrical portion of each spike is at least 0.375 inches long.

5. The overcoat bucket support apparatus as recited in claim 4, wherein the cylindrical portion of the spike has a tip that is less than 0.100 inch in diameter.

6. The overcoat bucket support apparatus as recited in claim 1, wherein the spikes are removable from the annular base.

7. The overcoat bucket support apparatus as recited in claim 1, further including spaced apart apertures formed through the cylindrical sidewall.

8. The overcoat bucket support apparatus as recited in claim 1, wherein the tabs include gripping ledges extending upward from an upper planar surface of the tabs.

9. An overcoat bucket support apparatus, the apparatus comprising:

an annular ring adapted for supporting a bottom portion of a bucket, the annular ring having an annular base with a central opening, wherein an upper surface of the annular base has a cylindrical sidewall extending upward from an outer edge of the upper surface of the annular base, wherein the cylindrical sidewall having spaced apart apertures formed through the cylindrical sidewall; further wherein an inner edge of the annular base has an annular lip extending upward from the inner edge of the annular base; further wherein a lower surface of the annular base has spaced apart spikes extending downward from the lower surface of the annular base; and further wherein the cylindrical sidewall has spaced apart pliable tabs extending inward towards a center of the annular ring from the cylindrical sidewall.

10. The overcoat bucket support apparatus as recited in claim 9, wherein the spikes include a cylindrical portion extending from a conical base.

11. The overcoat bucket support apparatus as recited in claim 10, wherein a length of a cylindrical portion of each spike is at least 0.375 inches long.

12. The overcoat bucket support apparatus as recited in claim 11, wherein the cylindrical portion of the spike has a tip that is less than 0.100 inch in diameter.

13. The overcoat bucket support apparatus as recited in claim 9, wherein the spikes are removable from the annular base.

14. The overcoat bucket support apparatus as recited in claim 9, wherein the tabs include gripping ledges extending upward from an upper planar surface of the tabs.

* * * * *